US006279658B1

(12) United States Patent
Donovan et al.

(10) Patent No.: US 6,279,658 B1
(45) Date of Patent: Aug. 28, 2001

(54) METHOD OF FORMING AND SERVICING WELLBORES FROM A MAIN WELLBORE

(75) Inventors: Joseph F. Donovan; Roger P. Herbert, both of Spring; Christopher L. Gann, The Woodlands; Michael H. Johnson, Flower Mound, all of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 08/947,073

(22) Filed: Oct. 8, 1997

Related U.S. Application Data

(60) Provisional application No. 60/031,444, filed on Oct. 8, 1996.

(51) Int. Cl.[7] ..... E21B 43/14

(52) U.S. Cl. ..... 166/313; 166/50; 166/250.15; 166/369; 166/266

(58) Field of Search ..... 166/50, 52, 266, 166/268, 313, 369, 250.15, 272.7, 246, 59.1

(56) References Cited

U.S. PATENT DOCUMENTS

| | | | | |
|---|---|---|---|---|
| 4,044,830 | * | 8/1977 | Van Huisen | 166/267 |
| 4,573,541 | | 3/1986 | Josse et al. | 175/78 |
| 4,607,888 | * | 8/1986 | Trent et al. | 299/2 |
| 5,074,360 | * | 12/1991 | Guinn | 166/281 |
| 5,732,776 | * | 3/1998 | Tubel et al. | 166/250.15 |

FOREIGN PATENT DOCUMENTS 2194572 3/1988 (GB) .

OTHER PUBLICATIONS

Duval et al.: "Production System is Pland for Iceberg Infested Waters", World Oil, vol. 190, No. 4, Mar. 1980, pp. 81–86.

N.N.: "Multidrain Drilling Ups Production", Petroleum Engineer International, vol. 56, No. 15, Dec. 1984, Dallas, Texas, USA, p. 34.

Collins G. et al,: "Two Wells Drilled From One Surface Bore with Downhole Splitter", Oil and Gas Journal, vol. 92, No. 40, Oct. 3, 1994.

* cited by examiner

*Primary Examiner*—William Neuder
*Assistant Examiner*—Zakiya Walker
(74) *Attorney, Agent, or Firm*—Madan, Mossman & Sriram, P.C.

(57) ABSTRACT

The present invention provides methods for forming multiple wellbores from a single location. A relatively large diameter main wellbore is drilled to a known depth. A plurality of spaced apart wellbores are formed from the bottom of the main wellbore, wherein at least one such wellbore is a production wellbore for producing hydrocarbons from subsurface formations. Wellhead equipment for each production wellbore is installed at main wellbore bottom. Additional devices or equipment are also placed in the main wellbore, preferably near the bottom. Such equipment may include a fluid processing apparatus, chemical injection equipment for injecting chemicals or additives into the wellbores, compressors for injecting compressed gas into one or more of the production wellbores or for transporting a gas to the surface, robotics devices for placing and/or removing devices or materials from the wellbores, a control unit for monitoring and controlling apparatus and devices in the main wellbore and the production wellbore, and any other desired equipment for performing a useful function relating any of the wellbores. A secondary access wellbore may be formed from the main wellbore or the surface for storing apparatus that is used to monitor and/or control the operation of devises in the production wellbores during the various stages in the life of such wellbores. Some of the equipment deployed in the main wellbore is prefabricated and may be retrieved. selective redundant equipment is provided to allow uninterrupted production from the various wellbores.

15 Claims, 9 Drawing Sheets

External Cluster

Internal Cluster

Manifolding Clusters

METHOD OF FORMING AND SERVICING WELLBORES FROM A MAIN WELLBORE

CROSS-REFERENCE TO RELATED APPLICATIONS

This application takes the benefit under 35 U.S.C. §119(e) of the Provisional Application Serial No. 60/031,444, filed on Oct. 8, 1996.

BACKGROUND OF THE INVENTION

1. Field of the Invention

This invention relates generally to wellbore construction and more particularly to the construction of one or more wellbores from a large diameter wellbore that can act as a subsurface platform for drilling multiple wellbores and provide space for housing a variety of equipment that can be utilized to perform a host of functions or operations during the drilling, completion and production phases of such wellbores.

2. Background of the Art

To obtain hydrocarbons such as oil and gas, wellbores or boreholes are drilled from one or more surface locations into hydrocarbon-bearing subterranean geological strata or formations (also referred to in the industry as reservoirs). A large proportion of the current drilling activity involves drilling deviated and/or substantially horizontal wellbores extending through such reservoirs. To develop an oil and gas field, especially offshore, multiple wellbores are drilled from an offshore rig or platform stationed at a fixed location. A template is placed on the sea bed, which template defines the location and size of each of the multiple wellbores to be drilled. The various wellbores are then drilled from the template along their respective pre-determined wellpaths (or drilling course) to their respective depths. Frequently, ten to twenty offshore wellbores are drilled from an offshore rig stationed at a single location. In some regions, such as the North Sea, as many as sixty separate wellbores have been drilled from an offshore platform stationed at a single location. The initial drilling direction of several thousand feet of each such wellbore is generally vertical and typically lies in a non-producing (non-hydrocarbon bearing) formation.

Each wellbore is then completed to produce hydrocarbons from its associated subsurface formations. Completion of a wellbore typically includes placing casings through the entire length of the wellbore, perforating production zones and installing safety devices, flow control devices, zone isolation devices and other devices within the wellbore. Additionally, each wellbore has associated welihead equipment, generally referred to as a "tree" and includes a blow-out-preventor, a riser or stuffing box and other safety and fluid flow control devices.

The above-described wellbore construction requires drilling each such wellbore from the surface to its respective depth and then completing each such wellbore to its entire depth. Typically, the first several thousand feet of each such wellbore lie in non-hydrocarbon-producing formations. As an example, assume that there are ten wellbores drilled from an offshore platform, each having a nine-inch internal diameter. Further assume that there is no production zone for the initial five thousand feet for any of these wellbores. In this example, there would be a total fifty thousand feet (five thousand for each of the ten (10) wellbores) of non-producing wellbore that must be drilled and completed, serving little useful purpose. It is, therefore, desirable to drill as few upper portions as necessary from a single location or site, especially as the cost of drilling and completing offshore wellbores can exceed several tens of thousand dollars per each thousand feet of wellbore.

The production wellbores are relatively small in diameter and typically contain flow tubings and a variety of devices, leaving little or no space for installing other equipment, such as fluid processing equipment to separate oil, gas and water, compressors for transporting gas and fluids uphole, chemical injection equipment for treating fluids downhole, etc. Therefore, the above-described equipment and wellhead equipment that includes safety devices such as blow-out-preventor stacks, are usually installed on the earth's surface. Oil, gas and water separators are typically installed adjacent to the wellheads. During the production phase, fluids from each of the production wellbores are passed to the separator, which separates the constituents, which are then transported to their desired destinations.

The above-described equipment, whether installed on the earth's surface or on the sea bed, poses environmental risks and is susceptible to theft and damage. The cost to the wellbore operators can be significant if the equipment is damaged or if a blow-out occurs. It is therefore desirable to install much of the above-described equipment and power sources below the earth's surface. The wellbore construction methods of the present invention allow installing a variety of equipment below the earth's surface.

An important aspect of drilling a deviated or horizontal wellbore is to drill it along a predetermined wellpath or drilling course. During drilling of the wellbore, it is important to accurately determine the true location of the drill bit relative to a reference point so as to continuously orient or maintain the drill bit along the desired wellpath. This would require substantially continuously transmitting data relating to the drill bit location to the surface. However, the current drill strings usually include a large number of sensors to provide information about the drill bit location, formation parameters, borehole parameters and the tool condition and a relatively low data transmission telemetry, such as the mud-pulse telemetry. In such systems, the drill bit location data is transmitted to the surface periodically. The drill bit sometimes significantly veers off course, requiring larger adjustments to maintain the drilling course, which can be very time consuming. The present invention provides a method for continuously determining the drill bit location which allows the driller to drill the wellbore along the predetermined wellpath.

During the completion of a wellbore, a number of devices are utilized in the wellbore to perform specific functions or operations. Such devices may include, packers, sliding sleeves, perforating guns, fluid flow control devices, and a number of sensors. To efficiently produce hydrocarbons from wellbores drilled from a single location or from multi-lateral wellbores, various remotely-actuated devices can be installed to control fluid flow from various subterranean zones. Some operators are now permanently installing a variety of devices and sensors in the wellbores. Some of these devices, such as sleeves, can be remotely controlled to control the fluid flow from the producing zones into the wellbore. The sensors are used to periodically provide information about formation parameters, condition of the wellbore, fluid properties, etc. One problem with this approach is that the distance between the transmitter and certain sensors in the wellbore can be great, necessitating the installation of relatively large power sources in the wellbore for providing power to such devices and sensors. Additionally, the quality of the data received from the sensors can suffer because of the large distance between such devices and the surface. It is therefore desirable to locate the power sources and communication and data processing devices closer to the downhole devices and sensors.

The vast majority of the oilfields contain a plurality of spaced wellbores. Each such wellbore requires services during its production life. Such services are provided from the wellhead equipment installed at the uphole end of each such wellbore. In one embodiment of the present invention, one or more access wellbores are drilled at strategic locations in the field, wherein each such access wellbore is utilized to service a plurality of wellbores.

The present invention addresses the above-described problems with the prior art methods for constructing multiple wellbores from a single location and multi-lateral wellbores. In one method, the present invention provides for constructing a single relatively large diameter deep wellbore (access or main wellbore) and then forming a plurality of relatively small diameter wellbores from near the bottom of the main wellbore. The single main wellbore can significantly reduce the overall drilling length and provides space for installing certain types of equipment within the main wellbore. One or more of the smaller wellbores may be formed in non-producing formations in the vicinity of a group of production wellbores for storing power supplies, transmitters and receivers, data processing equipment to aid the drilling of other wellbores and to aid production of hydrocarbons from the production wellbores.

SUMMARY OF THE INVENTION

The present invention provides methods of forming multiple wellbores. In one method, a relatively large (diameter) and deep main or access wellbore is formed to a predetermined depth. A plurality of branch wellbores are formed from the main wellbore into reservoirs for producing hydrocarbons therefrom. Welihead equipment, including the blow-out-preventor stack, is preferably installed in the main wellbore. Additional equipment may also be placed in the main wellbore, preferably near the bottom. Such equipment may include: (a) fluid separation equipment for separating hydrocarbons, solids and water; (b) chemical injection equipment for injecting chemicals or additives into the wellbores or the fluid separation equipment; (c) compressors for injecting compressed gas, such as nitrogen, into one or more of the wellbores; (d) compressors for compressing gas from the branch wellbores to the surface; (e) robotics devices for performing an operation downhole, including placing and/or removing devices or materials from the wellbores, performing end work such as cutting, milling and reaming in the wellbores, inspecting wellbores and installing devices in the wellbores; (f) a control unit and data processing equipment for controlling devices in the wellbores and for processing information provided by various sensors placed in the wellbores; and (g) any other desired equipment for performing a useful function relating to the wellbores.

The fluid reaching the wellheads may be processed or at least separated in the main wellbore. With the above-described wellbore construction, formation fluids travel a relatively small distance from the perforation to the bottom of the main wellbore, because the formation fluids no longer need to travel to the earth's surface, several thousand feet from the bottom of the main wellbore. Since the pressure differential between the producing formation and the main wellbore bottom is substantially less than the pressure difference between the producing formation and the earth's surface, it is relatively easier for the formation fluids to travel to the main wellbore bottom compared to the surface. Due to the ease of reaching the main wellbore and the availability of physical space, pumps and processing equipment can be deployed in the main wellbore for relatively easy and efficiently transport of hydrocarbons to the surface. Further, a riser may be movably placed (stored) in the main wellbore for later use. The riser may be moved over any desired wellbore to perform a completion, production or workover operations.

Additionally, a secondary access wellbore may be drilled from the first or main wellbore to provide storage for equipment that may be utilized for controlling and/or monitoring drilling direction, actuating devices during completion and production phases of the wellbores and for monitoring and controlling wellbore performance by receiving and processing responses from permanently installed sensors in the secondary wellbores throughout the life of the wellbores.

Some of the equipment is preferably prefabricated at the surface and then deployed into the main wellbore. The prefabricated equipment may include a processing unit and a plurality of pipes. One or more wellbores are then drilled from the pipes. The pipes may be in fluid communication with each other. Formation fluids from the various wellbores is processed by the processing unit. The prefabricated equipment may provide certain redundant equipment and may be retrievable.

In an alternative method, a main wellbore may be drilled in an oilfield to service a number of pre-existing wellbores. Such an access wellbore may be connected to one or more of the preexisting wellbores and may contain the desired equipment, such as data processing and communication equipment, power sources, fluid processing equipment, transmitters for transmitting commands to devices located in its associated wellbores, receivers for receiving signals from sensors at the surface or in other wellbores, etc. Wellbores can be drilled from the main wellbore to intersect the existing wellbores and may be used to enhance recovery from any number of the preexisting wellbores. This method allows for managing the production from an entire field through one or more strategically located main wellbores.

Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein.

DETAILED DESCRIPTION OF THE PREFERRED EMBODIMENTS

In general, the present invention provides methods for forming multiple wellbores from a relatively large diameter main or access wellbore and wherein the main wellbore may also be utilized to house equipment and devices useful for performing certain functions or operations relating to one or more of the wellbores. FIGS. 1, 1A, 2, and 2A illustrate the formation of multiple wellbores from the main wellbore that is formed primarily in a non-producing formation. FIG. 3 illustrates an example of forming a secondary wellbore from the main wellbore that can be utilized for retrievably or permanently storing certain devices, sensors and materials and or for waste disposal. The secondary wellbore may contain apparatus that facilitates or communicates with various devices and sensors in other wellbores and/or at the surface to provide more efficient communication between such devices and sensors during drilling, completion of such other wellbores and then during the production of hydrocarbons from such wellbores.

Figure 1:
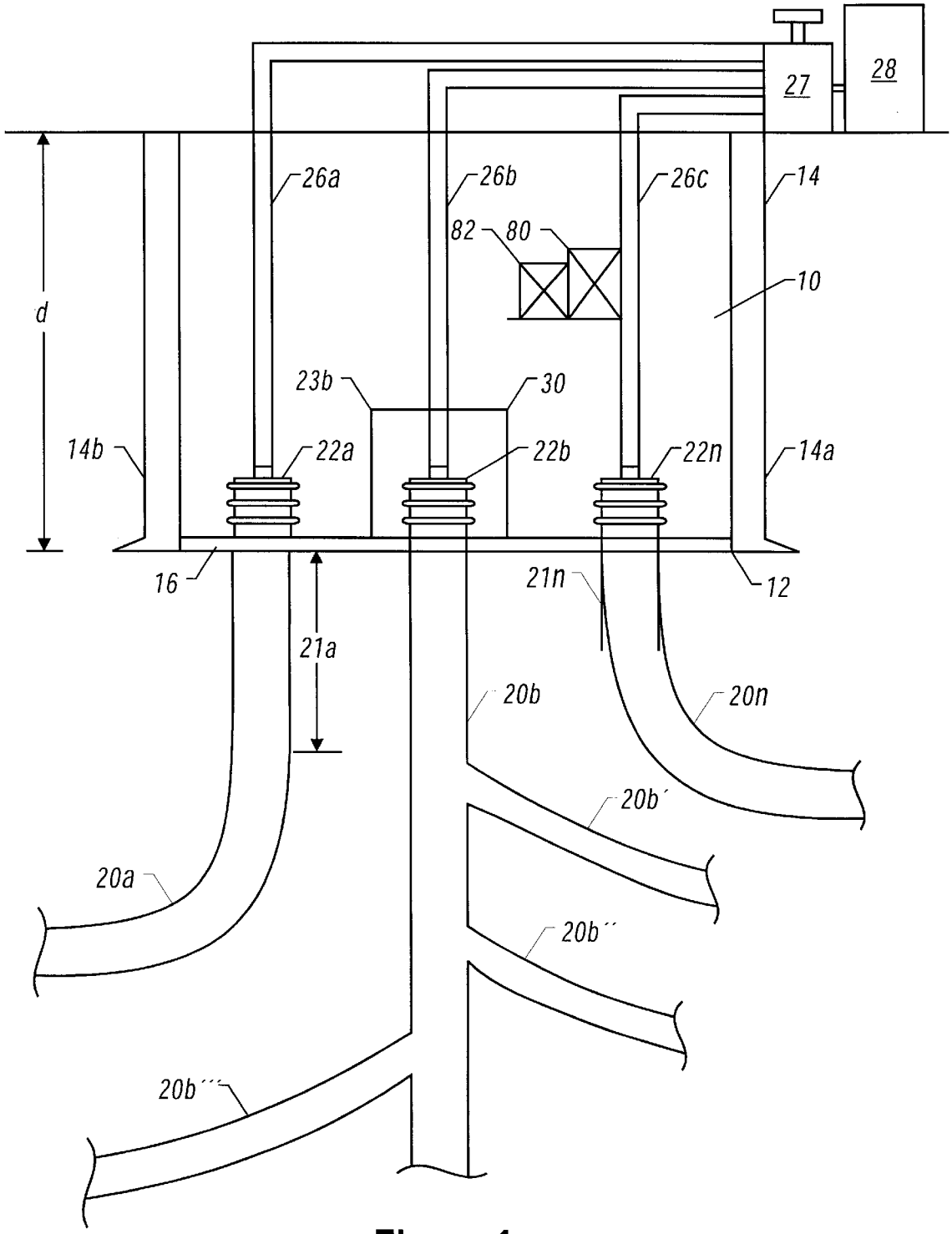
FIG. 1 shows a schematic illustration of a plurality of wellbores formed from a large diameter main or access wellbore and with the access wellbore containing certain equipment therein.
Figure 1A:
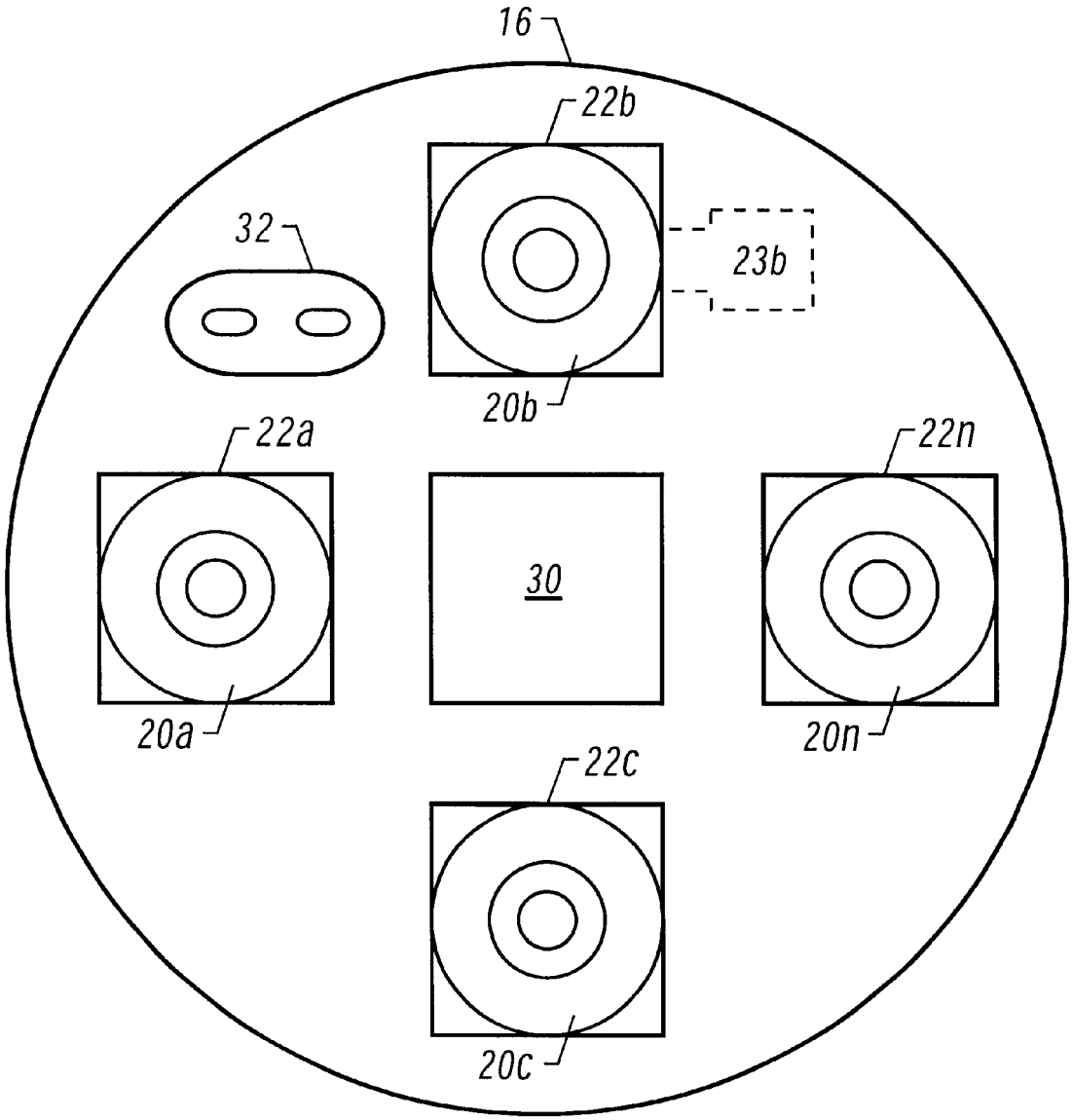
FIG. 1*a* shows a schematic illustration of the placement of certain equipment within the access wellbore of FIG. 1 in relation to the plurality of wellbores.

For the purposes of illustration only and not as any limitation, the present invention is described in terms of forming multiple wellbores from an offshore platform stationed at a predetermined location. The methods described herein, however, are equally applicable to the formation of onshore wellbores. Referring to FIGS. 1 and 1A, to form multiple wellbores according to one method of the present invention, a relatively large diameter main or access wellbore 10 is drilled from a suitable platform or rig (not shown), such as a ship, jack-up rig or a semi-submersible rig. The main wellbore 10 terminates at a bottom 12 having inside dimensions that are sufficiently large to allow drilling of a desired number of branch wellbores from the bottom 12. A suitable casing 14 is placed in the main wellbore 10. The casing may be preformed with one or more anchors 14*a* and installed in place after drilling of the wellbore to its desired depth. A template 16 defining the size and location of the branch wellbores to be drilled is set at the main wellbore bottom 12. Branch wellbores 20*a*–20*n* are then drilled by conventional methods through the template 16. The main wellbore 10 is preferably drilled to a depth "d" which is a certain distance above the branch wellbore which has the least upper vertical section. In FIG. 1, branch wellbore 20*n* is shown to have the least upper section 21*n*. The branch wellbores 20*a*–20*n* are drilled along their respective predetermined or planned wellbore paths for producing hydrocarbons from subterranean formations. One or more lateral wellbores may also be drilled from any of the 20 branch wellbores, such as wellbores 20*b*', 20*b*" and 20*b*"' drilled from the branch wellbore 20*b*. Lateral wellbores, such as 20*b*'–20*b*"' are referred to herein as multi-lateral wellbores.

Each of the branch wellbores 20*a*–20*n* and the multi-lateral wellbores 20*b*'–20*b*"' is completed as desired by known methods in the oil industry to produce hydrocarbons from its associated reservoirs. Safety devices and other equipment, such as fluid flow control valves, blow-out-preventors, pressure measuring devices (collectively referred to herein as the "wellhead equipment") are preferably installed at the bottom of the main wellbore 10. FIG. 1 shows wellhead equipment 22*a*–22*n* installed at the main wellbore bottom 12 for branch wellbores 20*a*–20*n* respectively. In the wellbore configuration shown in FIG. 1, fluid from each of the branch wellbores 20*a*–20*n* is transported to a surface control unit 27 via separate flow lines 26*a*–26*n* respectively. The fluid from the control unit 27 passes to a separator 28 (at the sea bed for offshore operations and at the earth's surface for onshore operations), which separates oil, gas and water. The separated fluids are then transported from the separator 28 to their desired locations. To facilitate the flow of fluids from the branch wellbores 20*a*–20*n* to the surface, a pump, such as pump 23*b* associated with wellbore 20*b* (see FIG. 1A), or a common pump for more than one branch wellbores 20*a*–20*n* may be installed in the main wellbore 10. Any other equipment, such as shown by numerals 30 and 32, may be installed in the main wellbore to perform a useful operation relating to the wellbores 10 and/or 20*a*–20*n*, as more fully explained later.

Figure 2:
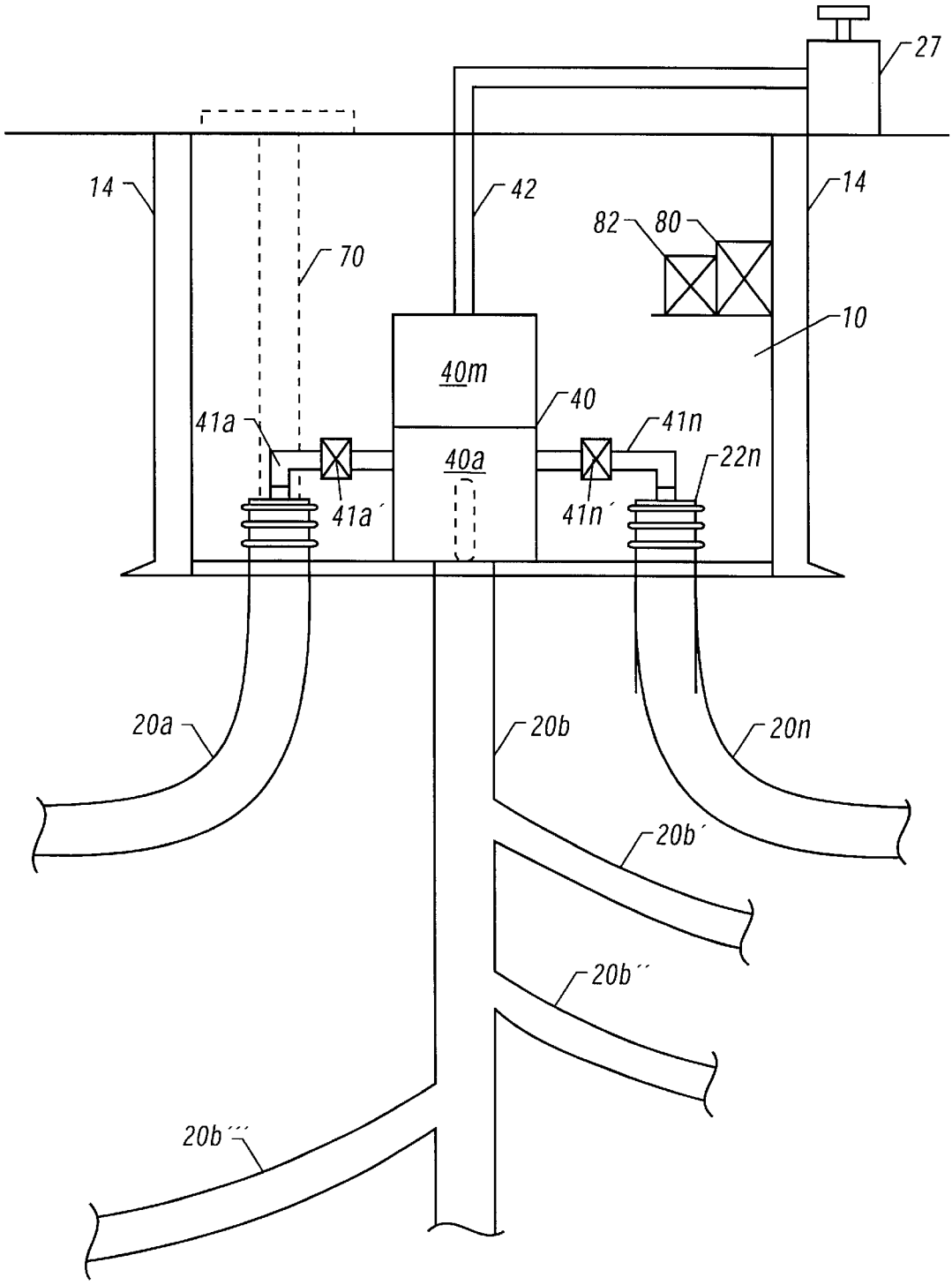
FIG. 2 shows a schematic illustration of an alternative placement of certain equipment in the main wellbore shown in FIG. 1.
Figure 2A:
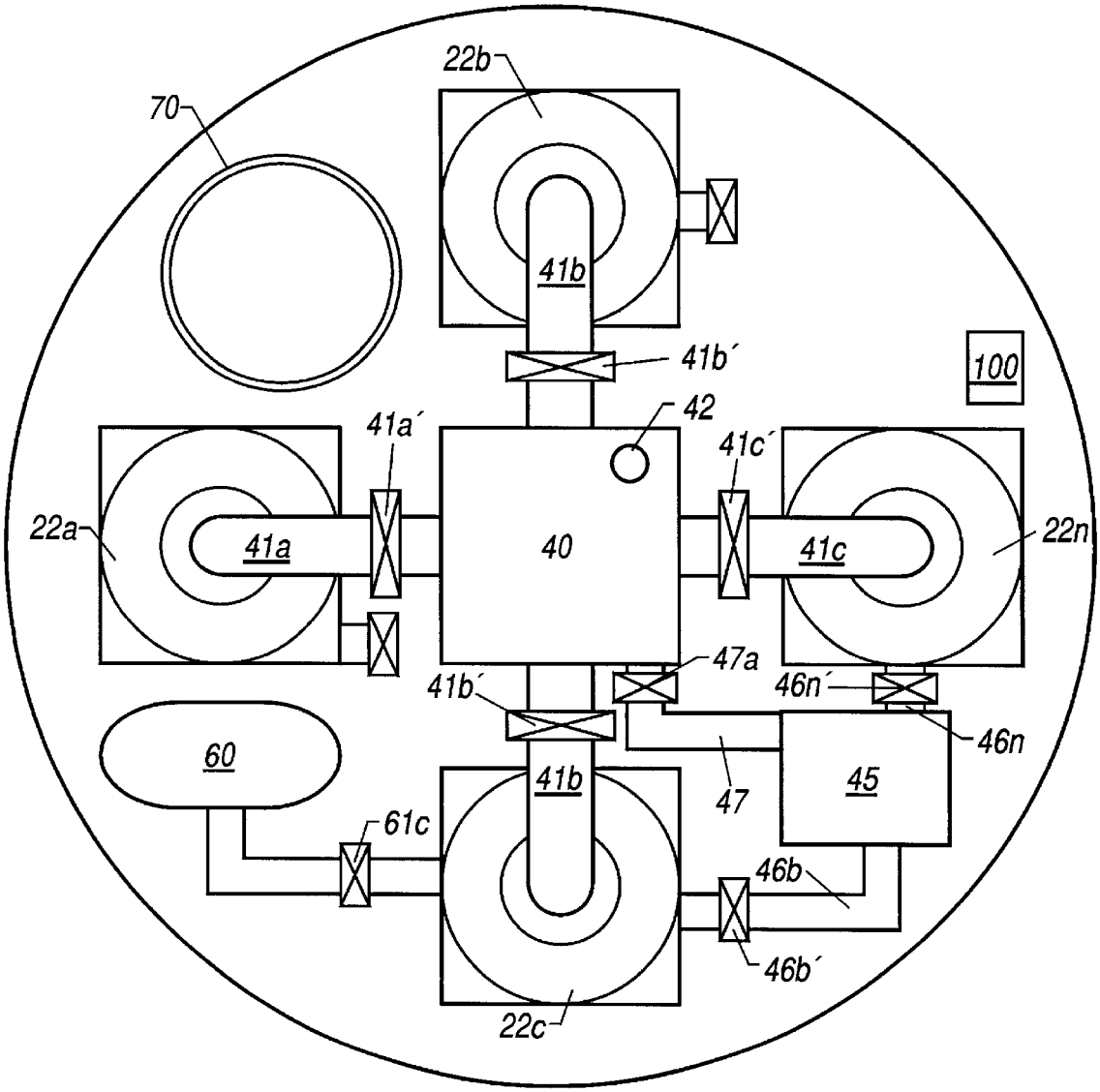
FIG. 2A shows yet another placement of certain equipment in the main wellbore shown in FIG. 2.
Figure 3:
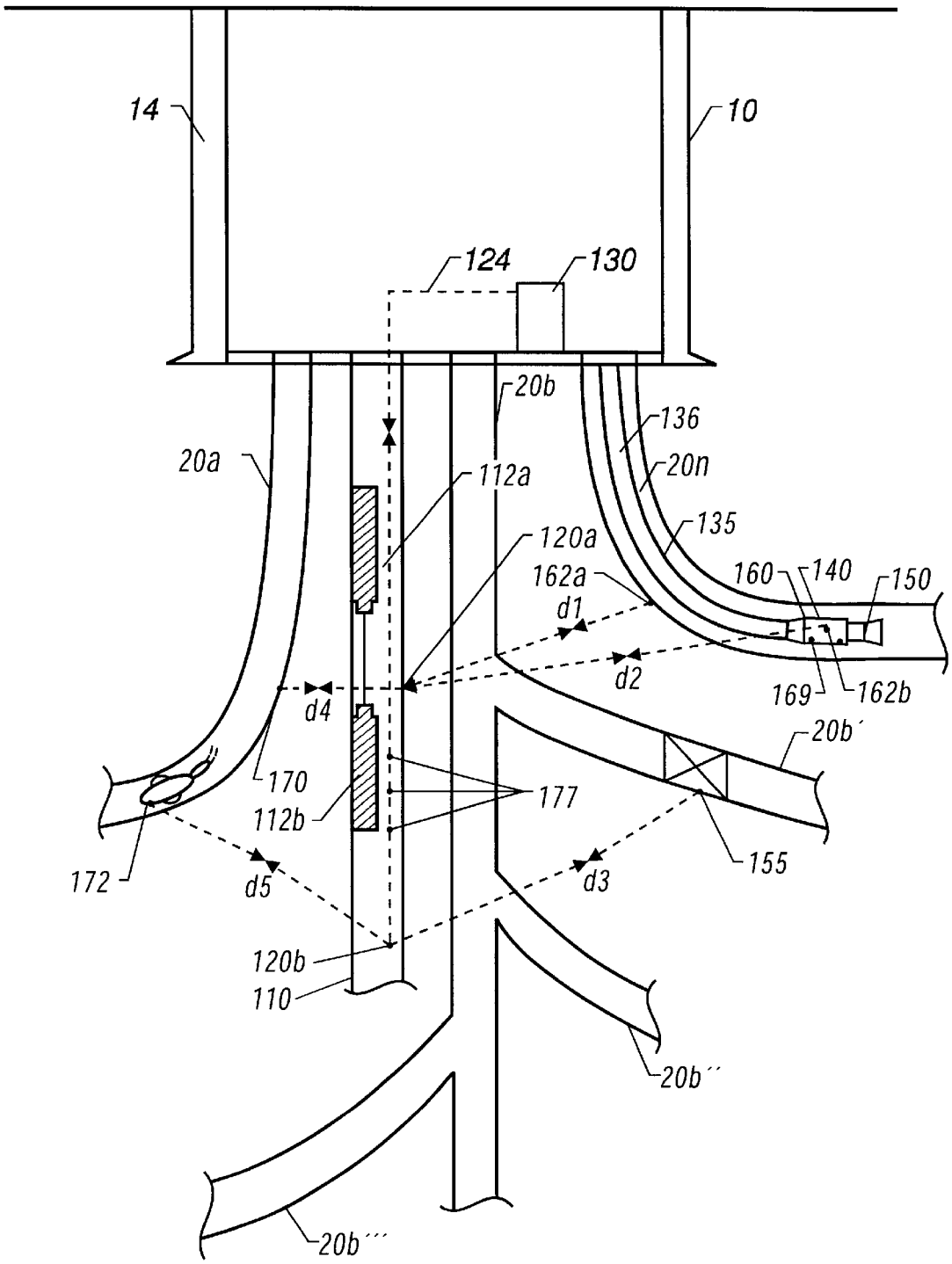
FIG. 3 shows a schematic illustration of multiple wellbores formed from a main wellbore, wherein at least one wellbore is a non-producing wellbore that is utilized for facilitating the drilling, completion and operations of other wellbores.

FIGS. 2 and 2*a* show the placement and use of certain types of equipment and devices within the main wellbore 10. A fluid processing unit 40 may be placed in the main wellbore 10 for processing fluids from one or more of the branch wellbores 20*a*–20*n*. In the embodiment shown in FIGS. 2 and 2*a*, fluid from each of the branch wellbores 20*a*–20*n* is passed to the fluid processing equipment 40 respectively via fluid lines 41*a*–41*n*. A separate fluid control valve 41*a*'–41*n*' may be connected to each of the lines 41*a*–41*n* to independently control the fluid flow from each of the branch wellbores 20*a*–20*n* into the fluid processing unit or equipment 40. The fluid processing unit or equipment 40 may include several stages or several different types of equipment, generally designated herein by numerals 40*a*–40*m*. For example, one stage or equipment 40*a* may be a fluid separator that separates oil, gas, water and solids. Another stage or equipment may include equipment for processing or treating a fluid prior to transporting it to the surface. For example, the second stage may include chemical treatment equipment for treating one or more of the separated fluids. The required chemicals may be stored in the main wellbore in a chemical storage tank (source) 45 and controllably supplied to the fluid processing equipment 40 via a line 47 and a control valve 47*a*. Alternatively, chemicals from the source 45 may be selectively injected into any of the branch wellbores 20*a*–20*n* via a separate line and control valve associated with each such wellbore. As an example, FIG. 2A shows that chemical from the source 45 is supplied to the branch wellbore 22*c* via a line 46*b* and control valve 46*b*' and to wellbore 20*n* via a line 46*n* and control valve 46*n*'. The processed fluid is then transported from the fluid processing unit 40 to the surface via a suitable conduit 42. Additionally, different types of chemicals may be stored in separate storage tanks in the main wellbore 10 and supplied to the downhole equipment or the branch wellbores in the manner described above. Also, chemicals may supplied from one or more sources at the surface (not shown).

Still referring to FIGS. 2 and 2A, a gas compressor 60 may be deployed in the main wellbore 10 for injecting compressed gas, such as nitrogen, into any of the branch wellbores 20*a*–20*n* to aid in the formation, completion, production or servicing of any of the branch wellbores 20*a*–20*n*. A gas compressor may also be provided to compress gas from the main wellbore, such as the gas separated by the equipment 40 to the surface.

A riser 70 may be permanently hung or stored in the main wellbore 10 for use with any of the branch wellbores 20*a*–20*n* during the drilling, completion, production or servicing of such wellbores. To install the riser over a particular branch wellbore, it is moved from its normal stored position, as shown by the dotted lines 70, to a suitable position over the wellhead equipment associated with that particular branch wellbore. To perform an operation in a particular branch wellbore, a second riser (not shown) is placed between the riser 70 and the offshore platform (not shown). Any suitable apparatus or method may be utilized to move the riser 70 to a desired location within the access wellbore 70 and to install the second riser between the riser 70 and the offshore platform.

One or more robotics devices 80 may be placed in the main wellbore 10 for performing one or more desired operations downhole. For example, the robotics device 80 may be utilized to fetch or retrieve a device 82 stored in the main wellbore 10 and move it to a desired location within the main wellbore 10 or into a selected one of the branch wellbores 20*a*–20*n*. The robotics device 80 may be commanded to install a device, such as a pressure sensor, a temperature sensor or a fluid control valve, at a selected location downhole. It may also be directed to remove a device from a downhole location. In some applications, it may be desirable to include in the robotics device 80 inspection devices or sensors for inspecting a branch wellbore. Such a robotics device may be periodically commanded to travel through a desired branch wellbore and gather data relating to the operation and condition of such a wellbore or a portion thereof. The robotics devices may also be utilized (a) to measure parameters of interest relating to the branch wellbore 20*a*–20*n* or the formations surrounding such wellbores, (b) to determine the fluid flow through individual production zones or portions thereof within any of the branch wellbores 20*a*–20*n*, (c) to perform inspection of a casing in any of the wellbores for corrosion, pits, cracks and scaling, (d) to determine if coning is occurring at a location or zone in a particular branch wellbore, (e) to actuate a device downhole, such as a sliding sleeves, and (f) to perform a service operation, such reaming, cutting and milling.

One or more power sources such as power supplies or power generation units are preferably stored in the main wellbore for providing electrical power to selected downhole equipment. One or more hydraulic power units may also be provided in the main wellbore for supplying pressurized fluid to any hydraulically operated equipment in the main wellbore and/or in any of the branch wellbores. This places the power units closer to the equipment to be operated.

It should be noted that the main wellbore 10 has a relatively large diameter, typically ranging from about eighteen inches (18") to greater than sixty inches (60")) and may extend several thousand feet, typically greater than one thousand (1000) feet into the earth, thereby providing a large amount of underground space for installing equipment and devices therein. Accordingly, the equipment in the main wellbore 10 may be placed at any suitable location in the main wellbore 10 and in any suitable configuration.

It should be further noted that during the drilling of a wellbore, such as any of the branch wellbores 20*a*–20*n*, a number of devices are utilized to perform a variety of operations and/or to provide useful information about the drilling and formation parameters. Additionally, during the completion of a producing wellbore, such as the completion of any of the branch wellbores, a number of devices and sensors are installed for completing the wellbore and/or to facilitate the production of hydrocarbons over the life of such wellbores. Recently, the trend has been to install remotely-actuated devices and to install a variety of sensors permanently into producing wellbores to optimize the hydrocarbon production throughout the life of such producing wellbores. In the present invention, such devices may operated or monitored from a control unit placed in the main wellbore. Additionally, such a control unit may be utilized to obtain information from the sensors in the various wellbores and to process such information according to programmed instructions as more fully explained below.

The operation of any of the equipment in the main wellbore 10 and devices in the branch wellbores 20*a*–20*n* may be controlled by a control unit 100 (FIG. 2A) placed in the main wellbore 10. The control unit may, however, be placed at the surface. The control unit 100 preferably includes a computer or one or more microprocessor devices and associated circuitry for receiving information from the various equipment, devices and sensors in the main wellbore and from the various devices and sensors placed in the branch wellbores 20*a*–20*n*. The control unit 100 preferably computes the values of selected parameters and manipulates data in accordance with programmed instructions provided to the control unit 100. The control unit 100 includes memory for storing data and programmed instructions. The control unit 100 controls the equipment and devices in the main wellbore 10 and the branch wellbores 20*a*–20*n* in response to the values of the operating parameters in accordance with the programmed instructions provided to the control unit 100. The desired programs may be stored in the memory associated with the control unit 100 or provided from another location.

As noted earlier, during different phases in the life of a wellbore, there is a need to remotely operate certain devices, receive data or signals from a variety of sensors and process such data and signals to obtain information that is utilized to maximize hydrocarbon production. Due to the great distance between the surface and the location of reservoirs, hostile downhole environment, limited space, and low data transmission rates for commonly used telemetry techniques, such as mud-pulse telemetry techniques, it is desirable to have the control unit and associated transmitters, receivers and power supplies as close as possible to the devices in the wellbores. This can be accomplished by placing at least some of the devices in a secondary or access wellbore drilled either from the bottom of the main wellbore 10 as shown in FIG. 3 or from a suitable surface location (not shown).

FIG. 3 shows a secondary or branch access wellbore 110 formed from the main wellbore bottom 12 to a predetermined depth. The secondary wellbore 110 is preferably drilled prior to drilling any of the branch wellbores 20*a*–20*n*, because it can be utilized to facilitate the drilling and completion of the branch wellbores 20*a*–20*n* and to facilitate production of hydrocarbons after such wellbores have been in production. Further, it may be desirable that the secondary wellbore 110 not be utilized for producing hydrocarbons. It may be a sacrificial wellbore, in that, it is to be utilized to facilitate other drilling and production activities. To that end, the secondary wellbore may be strategically placed relative to the other planned branch wellbores, such as wellbores 20*a*–20*n*. In such instances, it is desirable to form the secondary wellbore 110 substantially in non-producing formations, as such formations tend to be harder than the hydrocarbon bearing formations. Additional secondary wellbores (not shown) may also be formed from the main wellbore or from a surface location.

In the present invention, various types of transmitters, receivers, and sensors, generally denoted herein by numerals 120*a*–120*b*, are placed at or conveyed to selected locations in the secondary wellbore 110. A local control unit for processing data from such sensors may be placed within the secondary wellbore 110. A desired number of power supplies, in the form of electricity generators or rechargeable batteries 112*a*–112b, are suitably placed in the wellbore 110 for providing the required power to the devices and sensors 120*a*–120*b* in the secondary wellbore 110. As examples and not as limitations, the use of the secondary access wellbore 110 to perform certain functions and operations during different phases in the life of other wellbores will now be described. It will be noted that the secondary wellbore 110 may be utilized to perform a variety of other functions or operations without departing from the concepts illustrated herein.

Certain uses of a secondary access wellbore, such as the wellbore 110, during the drilling of a wellbore will now be described with reference to wellbore 120*n* and FIG. 3. During drilling, a drilling assembly, such as assembly 160 having a drill bit 150 at an end thereof and a plurality of formation evaluation and other sensors, generally denoted herein by numeral 140, is utilized to drill a wellbore, such as wellbore 20*n*. As noted earlier, it is desirable to drill the wellbore 20*n* along a course that will maximize hydrocarbon production from the subsurface reservoirs. Typically, to start drilling the wellbore 20*n*, the wellbore is drilled along a predetermined course. Data from the various formation evaluation sensors and other sensors 140 is periodically evaluated and the drilling course is adjusted so as to drill the wellbore 20*n* along a the most desired or optimum path.

The secondary wellbore 110 may be utilized to determine the true location of the drill bit 150 during the drilling of the production wellbore 20*n* and for adjusting the drilling direction of the drill bit. During the drilling of the branch wellbore 20*n*, when the sensor 140 is at location 162*a*, the sensor 140 transmits signals relating to the true position of the drill bit relative to a surface location. The sensor 120*a* in the secondary wellbore 110 detects such signals and transmits them to the control unit 130, which processes such signals to provide the true location of the drill bit. The signals transmitted by the sensor about the drill bit 150 location may be in the form of acoustic signals. The use of the sensor 120*a* provides a three point geometry, which provides an accurate measure of the drill bit 150 location under the earth. If required, the drilling direction may be corrected by remotely adjusting a downhole device, such as remotely-operated kick-off device 169 or by making some other adjustment to the drilling assembly 160. A transmitter placed in the secondary wellbore 110 may be utilized to adjust the kick-off device 169. The sensor 120*a* may also receive data from other sensors 140 and either process, which data may be processed by a suitable control circuit within the wellbore 110 or transmitted to the control unit 130 for further processing. This data may then be processed by the control unit 130 in the main wellbore 10 or a similar unit at the surface (not shown). The data transmitted by the sensor 140 in the drill string 135 may relate to formation parameters of the formation surrounding the wellbore 20*n*, wellbore and/or the operating condition of the drill stem. The above-described method of receiving the data at the secondary wellbore 110 is repeated periodically, such as when the drill bit has moved to the location 162*b*, as shown in FIG. 3.

An example of a use of the secondary access wellbore 110 during the completion phase will now be described with reference to FIG. 3 and lateral wellbore 20*b*' drilled from the branch wellbore 20*b*. As noted earlier, during completion, a number of devices are set to perform particular functions. They may include a remotely operable sliding sleeves, packer, perforating device, flow control valve for controlling flow of fluids through the production wellbore, a pressure sensor and a temperature sensor. For example, FIG. 3 shows a device 120*b* in the secondary wellbore 110 controlling the operation of a device 155 during the completion phase of the wellbore 20*b*'. The signal transmission path between the device 120*b* and the device 155 is indicated by the dotted path $d_3$.

An example of the use of the secondary access wellbore 110 during the production phase will now be described while referring to FIG. 3 and branch wellbore 20*a*. FIG. 3 shows a sensor 170 permanently placed in the wellbore 20*a*, which may be remotely activated to transmit certain information during the production phase of the wellbore 20*a*. The sensor may be a pressure sensor, temperature sensor, or a resistivity sensor for providing information about the water content. The device 120*a* may be utilized to activate the sensor 170 and to receive data transmitted by the sensor 170. Such received data may then be processed by the device 170 and/or transmitted to another device, such as the control unit 130 for further processing. The device 120*b* may be utilized to activate a device 172 installed in the wellbore 20*a*. The device 172 may be a fluid flow control device or a sliding sleeve device or any other device that is designed to be activated by the device 120*b*. The communication path between the device 120*a* and sensor 170 is shown by line d4 while path d5 shows the communication path between the device 120*b* and the device 172.

Additionally, a series of spaced seismic sensors 177, such as hydrophones or geophones, may be placed in the secondary wellbore 20*b*. During the drilling of a wellbore, such as the wellbore 20*n*, the seismic receivers detect acoustic signals produced by the drill bit 150 or generated by a source in the drill string 135. The detected signals are processed by the control unit 130 or by a surface unit. The seismic data so collected is then utilized to update preexisting seismic information about the earth formations (seismographs), which in turn can be utilized to update the wellpath of the wellbore 20*n* and the wellbores to be drilled in the future. Alternatively, a seismic source may be placed in the secondary wellbore 130 and the seismic receivers in the drill string.

The main wellbore 10 and the secondary wellbore 110 may be filled with a desired fluid. In some cases it may be desirable to fill the main wellbore, at least partially, with a heavy fluid (sometimes referred in the oil industry as the "kill-weight" fluid) to maintain the pressure in the wellbore 10 above the formation pressure to prevent any blow outs. As noted earlier, in some cases it may be more desirable to drill the secondary wellbore 110 from the sea bed or the earth's surface.

Forming a large diameter deep main wellbore, such as the wellbore 10 (FIG. 1) can significantly reduce the total drilling footage. It allows the installation of various types of equipment traditionally instead on the sea bed or the earth's surface in the main wellbore. The equipment placed near the main wellbore bottom can substantially closer to the reservoirs than the similar equipment installed at the surface. Any processing done near the formation can prevent asphaltene flocculation, reduce sediment deposition in tubings, and can significantly improve the performance of the wellbores. The equipment placed in the main wellbore can prevent damage and theft. The secondary access wellbore, such as wellbore 110 (FIG. 3), provides permanent subsurface locations relatively close to the production wellbores which can be utilized to facilitate the drilling and completion of such production wellbores and also facilitate the production of hydrocarbons from such wellbores. it further allows placing certain transmitters, sensors and data processing equipment much closer to the devices in the producing wellbores, allowing improved monitoring and control of such wellbores.

Figure 4A:
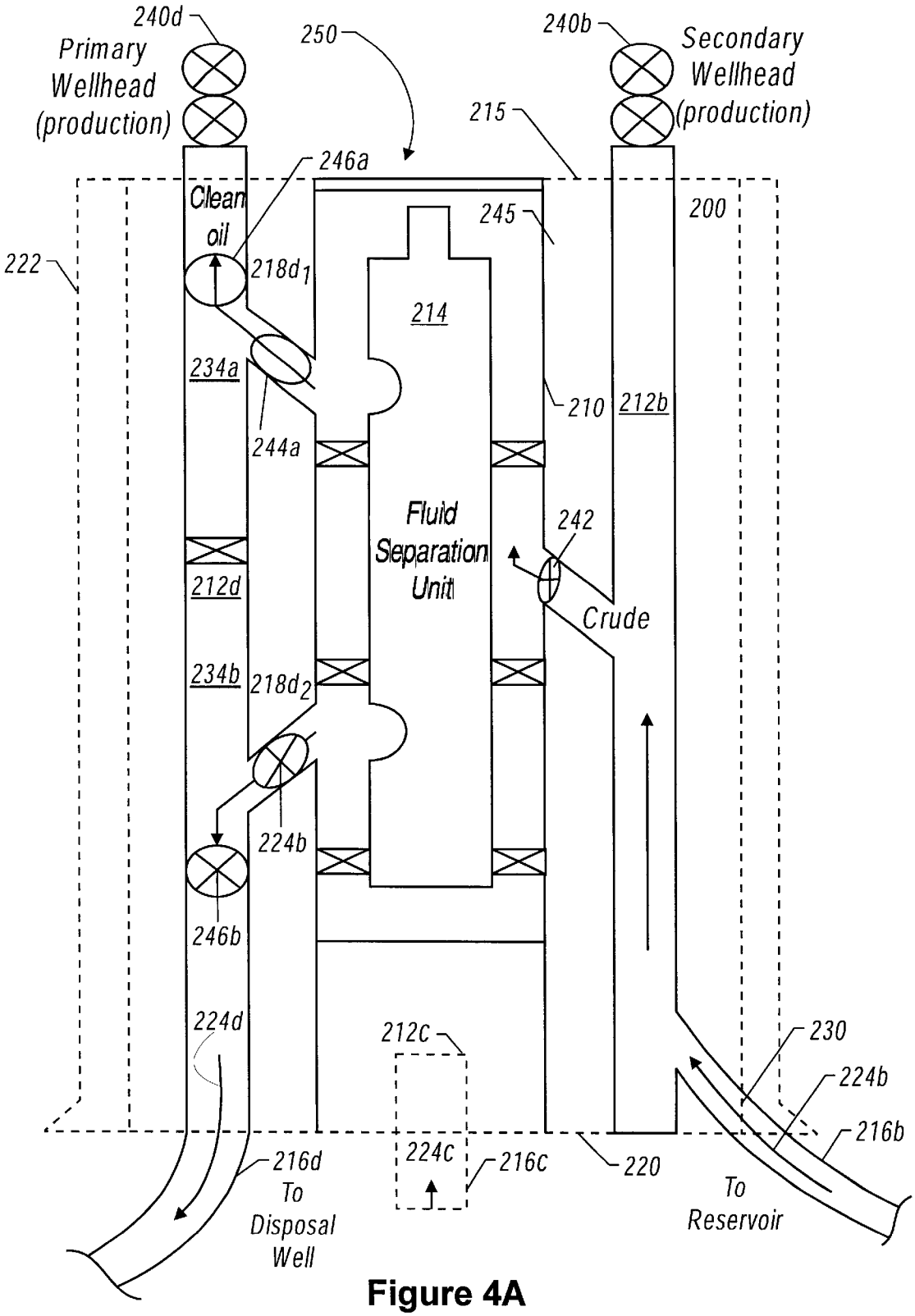
FIGS. 4A–4B show a schematic illustration of a main wellbore having therein certain preformed equipment.
Figure 4B:
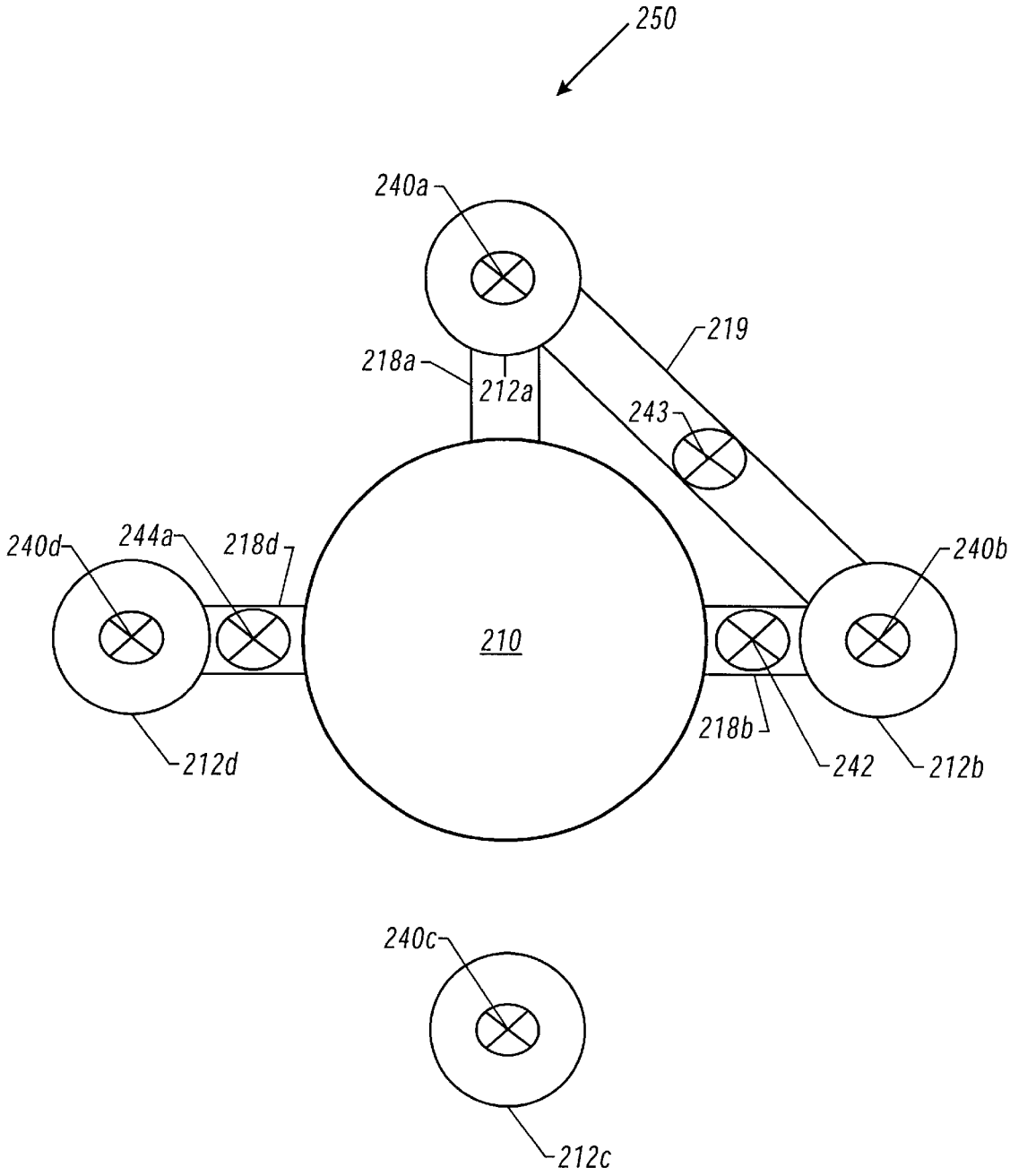

FIG. 4A shows a schematic of an elevation view of a main wellbore 200 containing an exemplary preformed equipment 250 (also referred to herein as the preassembled or prefabricated equipment). FIG. 4B shows a top view of the equipment 250. The preformed equipment 250 may include any type of assemblies and devices and may be configured in any desired manner to suit the particular requirements. The exemplary equipment 250 shown in FIGS. 4A–4B includes a main section 210 that contains a fluid processing unit 214 and a plurality of casings 212*a*–212*d*. Casings 212*a*, 212*b* and 212*d* are shown in fluid communication with the fluid processing unit 214 via conduits 218*a*, 218*b* and 218*d* respectively. Casings 212*a* and 212*b* are in fluid communication with each other via a conduit 219. Casing 212*c* is independent, i.e., it is not connected to any of the other casings or the fluid processing unit 214. The equipment 250 is preferably fabricated at the surface prior to deploying it in the main wellbore 200. In the example of FIGS. 4A–4B, the main wellbore 200 is drilled to a desired depth 220 which depending upon the application may or may not be lined with a casing shown by the dotted lines 222. Data and signals communications paths and any other structural or mechanical connections may be preformed in the equipment 250. The preassembled equipment 250 is then deployed or placed in the wellbore 200. Casings 212*a*–212*d* are designed for forming or drilling a separate wellbore therefrom. Accordingly, a separate wellbore is then formed from each of the casings 212*a*–212*d*. As shown, secondary wellbores 216b-216d respectively are formed from the casings 212*b*–212*d*. Such wellbores are also referred to herein as the secondary wellbores. The wellbore formed from the casing 212*a* is obscured by the wellbore 216*c* and is thus not shown. Casing 212*b* includes a preformed juncture 230 which facilitates the drilling of the lateral wellbore 216*b*.

In the example of FIGS. 4A–4B, the wellbores 216*b* and 216*c* are drilled into subsurface reservoirs for producing hydrocarbons 224*b* and 224*c* respectively. The wellbore (not shown) from the casing 212*a* may be a producing or non-producing well. The wellbore 216*d* is preferably drilled into a non-hydrocarbon bearing formation and is utilized for waste disposal purposes as described below or for some other purpose. The wellbores 216*a*–216*d* are then completed by any known method. The casing 212*d* is sealingly divided into an upper section 234*a* and a lower section 234*b* by a packer or another suitable device. The processed fluid from the processing unit 214 flows to the surface via the upper section 234*a* while the waste 224*d* from the processing unit is discharged into the wellbore 216*d* via the lower section 234*b*. Appropriate wellhead and fluid processing equipment 240*d* is installed over the casing 212*d* and it serves as the primary wellhead equipment for production wellbores 212*a*, 212*b* and 212*d*. Wellhead and fluid processing equipment 240*a* and 240*c* is respectively installed over the casings 212*a* and 212*c* as a secondary equipment, which is utilized for servicing their respective wellbores and as redundant safety and fluid processing units, especially when while the processing unit 214 is in service or is inoperable. Since the wellbore 216*c* is not in fluid communication with other wellbores in the system, it would require its own welihead equipment 240*c*. The open or unfilled areas 245 of the wellbore 200 may be capped at the surface with a cap 215, which would leave such area at the atmospheric pressure or it may be filled with a heavy fluid, grout or cement for safety or other reasons.

The equipment 250, in whole or in part, may be designed to be retrievable from the main wellbore 200. For example, the fluid processing unit 214 may be retrieved from the casing 210 for servicing or replacement. Similarly any of the casings may be retrieved to the surface while leaving the remaining equipment in the wellbore 200. Appropriate valves are provided to regulate the flow of the fluids between the various wellbores and the fluid processing unit 214. Valve 242 regulates the flow of the fluid 224*b* from the wellbore 216*b*. Valve 244*a* regulates fluid flow from the processing unit 214 to the primary wellhead equipment 240*d* while valve 244*b* regulates the flow of the waste or discharge 224*d* from the processing unit 214 to the wellbore 216*d*. Additionally, valve 243 regulates flow of the fluid between the casings 212*a* and 212*b*.

During normal production, the formation fluid from wellbore 216*b* flows into the processing unit 214 where water and other undesirable matters such as debris and asphaltenes are removed from the formation fluids. Clean fluid, such as oil, passes from the processing unit 214 into the upper section 234*a* via conduit 218$d_1$. Water and other waste is discharged into the wellbore 216*d* via conduit 218$d_2$. A pump 246*a* may be installed at a suitable location to facilitate the flow of the clean fluid to the surface. Also, a pump 246*b* may be installed in the lower section 234*b* to facilitate the flow of materials from the processing unit 214 into the waste wellbore 216*d*. In the equipment configuration described above, the fluid flow control devices are preferably installed outside the production wellbores 216*a* and 216*b*. This increases the efficiency of transporting the formation fluids uphole and allows easier passage of workover and servicing devices into such wellbores.

If a particular wellbore, such as wellbore 216*b* needs to be serviced, the valve 242 is closed allowing an operator to perform the required services via the wellhead equipment 240*b*. When the fluid processing unit 214 is inoperable, the formation fluid 224*b* from the wellbore 216*b* flows to the wellhead equipment 240*b* for processing. Fluid from the casings 212*a* and 212*b* may be combined by opening the valve 243. The above-described system provides redundancy of certain equipment and fluid processing, which allows uninterrupted production from wellbores when the processing unit 214 is inoperable. It should be noted that FIGS. 4A–4B show an exemplary equipment only and this invention is not limited to such equipment. It should be obvious that this invention provides a method of forming wellbores wherein a desired type of equipment is prefabricated at the surface and then installed in a main wellbore. One or more production wellbores are then formed from the main wellbore to produce hydrocarbons from the subsurface formations.

Figure 5:
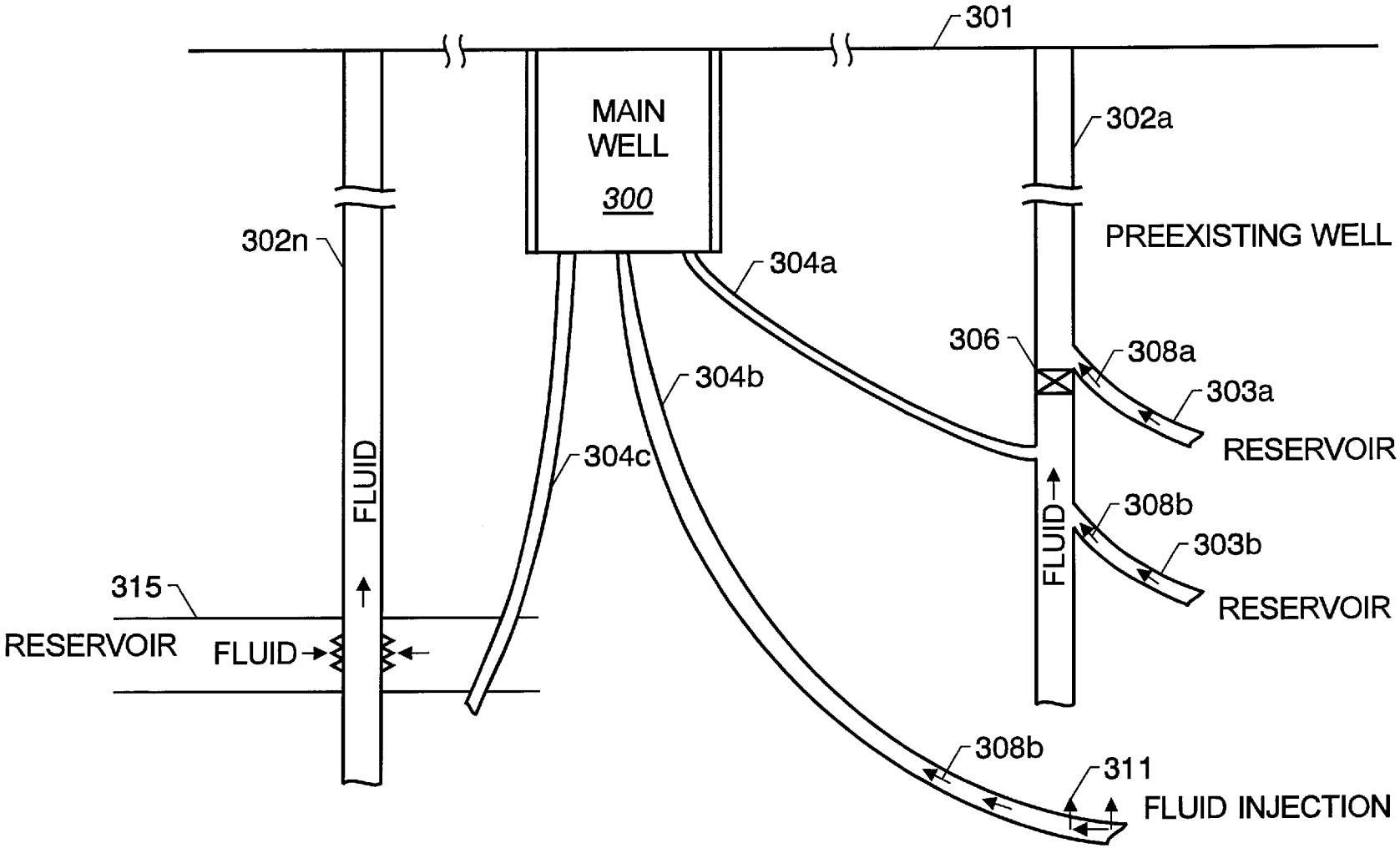
FIG. 5 show a schematic illustration of a main wellbore formed for managing a preexisting field.

FIG. 5 shows an exemplary illustration of the formation a main wellbore 300 in an oilfield 301 having a plurality of preexisting wellbores 302*a*–302*n*. The main wellbore 300 may be utilized service, workover, or revive one or more of such preexisting wellbores. The main wellbore 300 may also be utilized to drill additional wellbores for recovering hydrocarbons from the field 301. For the purpose of explanation and not as any limitation, FIG. 5 only shows certain specific applications of the wellbore 300.

Still referring to FIG. 5, the wellbore 302*a* contains two producing lateral wellbores 303*a* and 303*b*. The wellbore 302*n* is a vertical wellbore having a single production zone 315. During normal production, fluid 308*a* from the lateral wellbore 303*a* and fluid 308*b* from the lateral wellbore 303*b* flow to the surface via the wellbore 302*a*. If for some reason fluid flow from the lateral 303*b* is inhibited and cannot be economically remedied, then the wellbore 302*a* may be plugged at a location 306 below the upper lateral 303*a*. A recovery wellbore 304*a* may then be drilled to intersect the wellbore 302*a* or to directly intersect (not shown) the lateral 303*b* to recover hydrocarbons from the lateral 303*b*. Alternatively, a lateral wellbore 304*b* may be drilled to recover hydrocarbon from the reservoir taped by the lateral 303*b*. Instead, the lateral 304*b* may be utilized to inject fluids 311 into the subsurface formations to enhance recovery from one or more of the preexisting wellbores 302*a*–302*n*. A wellbore, such as wellbore 304*c* may be drilled for enhancing production from a particular zone, such as zone 315 associated with the wellbore 304*n*. Prior to this invention, the common practice is to service, workover or revive each preexisting wellbore separately, which requires moving the drilling and servicing equipment to each well as required. Further, such methods do not enable managing the entire field 301 in any comprehensive manner. The above-described method enables strategically locating one or more main wellbores, such as the wellbore 300, in the field, such as the field 301, and then drilling one or more wellbores from such main wellbores to manage production from several wells in the field, thereby increasing the overall production from such preexisting fields.

Figure 6A:
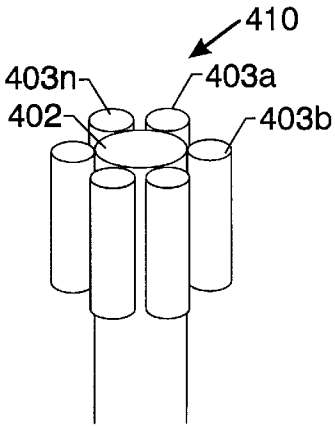
FIGS. 6A–6C show examples of preformed bundles of pipes for use in the main wellbore of FIGS. 1–5.
Figure 6B:
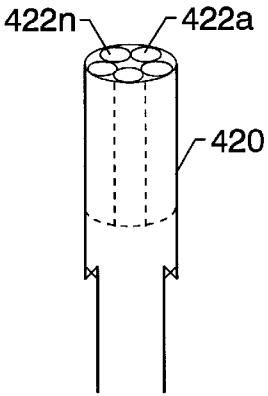
Figure 6C:
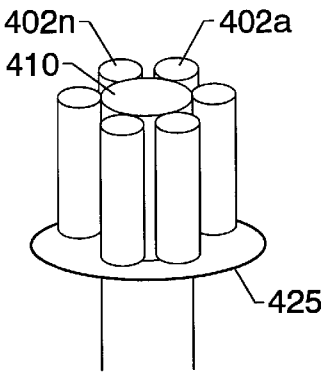

FIGS. 6A–6C show examples of certain preformed bundles of casings or pipes that may be installed in the main wellbore, such as wellbore 200. FIG. 6A shows a bundle 410 which contains a main casing 402 with a plurality of casing 403*a*–403*n* disposed around the main casing 402. FIG. 6B shows a large casing 420 containing a plurality of casings therein. The casing bundle of FIG. 6C is similar to that of FIG. 6A but includes a common manifold 425 at the bottom end of the cluster. The manifold 425 may be used as conventional templates for drilling multiple wellbores from a single location. Any number of other clusters of pipes may be prefabricated at the surface and deployed in the main wellbore. Each pipe in the cluster may be utilized for a specific purpose. for example a casing may be used to drill a wellbore, store chemicals or other materials, store equipment or devices including robots that can move materials or equipment and/or perform specified operations, or for any other purpose.

Figure 7B:
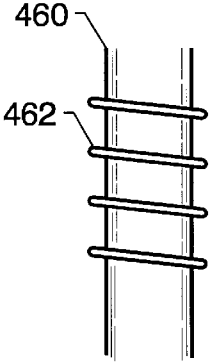
FIGS. 7A–7B show examples of certain uses of the casings utilized in the exemplary wellbores shown in FIGS. 1–5.
Figure 7A:
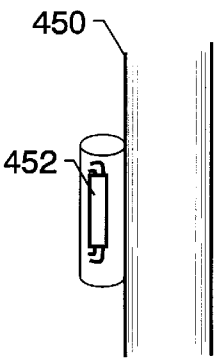

FIGS. 7A–7B provide examples of some of the uses of the pipes in the bundles described above. FIG. 7A shows a casing 450 containing a device 452, which may be a robot, vessel or chamber, power source such as a generator, fuel cell or battery, computing or data processing unit, communication device or a sensor or any other useful device. The casing 450 or another casing may also contain a unit that recharges the robot. FIG. 7B shows a main casing 460 which has a conduit 462 wrapped around the main casing. The casing 460 may be similar to the casing 10 of FIGS. 1–3. The conduit 462 may be utilized as a heat exchange unit or may contain sensors to provide formation evaluation information or may be utilized to inject chemicals at selected locations.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A method of forming a plurality of wellbores for producing hydrocarbons from earth formations, comprising:

(a) forming a main wellbore of relatively large cross-sectional area in the earth to a predetermined depth, said main wellbore terminating at a bottom;

(b) forming a plurality of secondary wellbores of smaller cross-sectional area than the main wellbore and extending from the main wellbore bottom, at least one secondary wellbore intersecting a hydrocarbon-bearing formation for producing hydrocarbons;

(c) installing a fluid processing unit and at least one casing with a fluid flow connection between the fluid processing unit and the at least one casing;

(d) allowing the formation fluid to flow from the at least one casing to the fluid processing unit;

(e) processing said received fluid to obtain a refined fluid; and (f) allowing the refined fluid to flow to a surface location.

2. The method of claim 1, further comprising including in the preselected equipment at least one of (a) a wellhead equipment placed on a secondary wellbore, (b) a compressor compressing a fluid from the main wellbore to the surface or a secondary wellbore, (c) a processor processing signals and data received from the secondary wellbores, (d) a fluid processing unit receiving fluids from the secondary wellbores and separating said received fluids into at least two constituents, (e) a chemical injection apparatus injecting a chemical from a source thereof into a secondary wellbore, (f) a pump for pumping hydrocarbons from the main wellbore to the surface, (g) a pump for pumping a fluid from the main wellbore into a secondary wellbore, (h) a control unit controlling the operation of a device downhole, (i) a robotics device to perform a selected operation downhole, (j) an electric generator fueled by the produced hydrocarbons, (k) a hydraulic power unit for providing a pressurized fluid downhole, (l) a template defining the drilling location of the secondary wellbores from the main wellbore, (m) casings, one casing for each said secondary wellbore and inter connected with the preselected equipment with predetermined communication paths.

3. The method of claim 1 further comprising prefabricating at least a portion of the preselected equipment before installing said preselected equipment in the main wellbore.

4. The method of claim 3, wherein the prefabricating includes one of (i) providing fluid flow connections between selected components of the preselected equipment, (ii) providing mechanical or structural connections between selected components of the preselected equipment; (iii) providing signal path connections for communicating signals and data, (iv) providing flow control devices at selected locations in the preselected equipment, and (v) providing one or more storage areas for storing selected materials.

5. The method of claim 1 further comprising including in the preselected equipment a plurality of casings with prefabricated fluid flow connections therebetween at selected locations.

6. The method of claim 5 further comprising positioning flow control devices at selected locations in the preselected equipment before installing said casings in the main wellbore.

7. The method of claim 1, wherein at least a portion of the preselected equipment is retrievable from the main wellbore to surface location.

8. The method of claim 1 further comprising including in the preselected equipment a primary apparatus that performs a preselected task and a redundant apparatus that can be operated to perform at least a part of the preselected task in lieu of the primary apparatus.

9. The method of claim 1 wherein the processing of the fluid results in waste materials and wherein said method further comprises discharging said waste materials into a subsurface formation.

10. The method of claim 1, wherein the fluid processing unit is one of (i) an oil and water separator, (ii) a chemical treatment unit, and (iii) a system that utilizes a biological mass for treating fluids.

11. A method of forming a plurality of wellbores for producing hydrocarbons from earth formations, comprising:

(a) forming a main wellbore of relatively large cross-sectional area in the earth to a predetermined depth, said main wellbore terminating at a bottom;

(b) installing preselected equipment within the main wellbore;

(c) forming a plurality of secondary wellbores of smaller cross-sectional area than the main wellbore and extending from the main wellbore bottom, at least one secondary wellbore intersecting a hydrocarbon-bearing formation for producing hydrocarbons; and (d) installing a riser within the main wellbore that is movably mounted for placement over at least one secondary wellbore formed from the main wellbore.

12. A method of forming a plurality of wellbores for producing hydrocarbons from earth formations, comprising:

(a) forming a main wellbore of relatively large cross-sectional area in the earth to a predetermined depth, said main wellbore terminating at a bottom;

(b) installing preselected equipment within the main wellbore;

(c) forming a plurality of secondary wellbores of smaller cross-sectional area than the main wellbore and extending from the main wellbore bottom, at least one secondary wellbore intersecting a hydrocarbon-bearing formation for producing hydrocarbons; and (d) placing a processor in the main wellbore, said processor receiving data from at least one sensor placed within a secondary wellbore and processing such data to provide information about a parameter of interest relating to the secondary wellbore.

13. The method of claim 12 further comprising selecting the parameter of interest from a group consisting of pressure, temperature, a wellbore fluid characteristic, a characteristic of the formation surrounding the production wellbore, a characteristic of a bottom hole assembly utilized for drilling the production wellbore, and a parameter relating to the flow of fluids from a formation into the production wellbore.

14. A method of forming a plurality of wellbores for producing hydrocarbons from earth formations, comprising:

(a) forming a main wellbore of relatively large cross-sectional area in the earth to a predetermined depth, said main wellbore terminating at a bottom;

(b) installing preselected equipment within the main wellbore;

(c) forming a plurality of secondary wellbores of smaller cross-sectional area than the main wellbore and extending from the main wellbore bottom, at least one secondary wellbore intersecting a hydrocarbon-bearing formation for producing hydrocarbons; and (d) filling the main wellbore with a flowable material to a predetermined level above at least a portion of the preselected equipment for holding said preselected equipment in position in the main wellbore.

15. A method of forming a plurality of wellbores for producing hydrocarbons from earth formations, comprising:

(a) forming a main wellbore of relatively large cross-sectional area in the earth to a predetermined depth, said main wellbore terminating at a bottom;

(b) forming a plurality of secondary wellbores of smaller cross-sectional area than the main wellbore and extending from the main wellbore bottom, at least one secondary wellbore intersecting a hydrocarbon-bearing formation for producing hydrocarbons; and (c) installing preselected equipment within the main wellbore that includes a robot that performs a predetermined operation downhole that is at least one of (i) installing a device downhole, (ii) removing a device from a predetermined location, (iii) performing a milling operation in one of the wellbores, (iv) performing a cutting operation, (v) performing a reaming operation, (vi) performing a testing function, (vii) performing casing inspection, (viii) gathering data from at least one sensor disposed in one of the wellbores, (ix) a repairing operation, and (x) activating a device downhole.

* * * * *